US005843280A

United States Patent [19]

Schiel

[11] Patent Number: 5,843,280

[45] Date of Patent: Dec. 1, 1998

[54] EXTENDED NIP PRESS DEVICE WITH INCLINED END FACE PLATES

[75] Inventor: Christian Schiel, Heidenheim, Germany

[73] Assignee: Voith Sulzer Papiermaschinen GmbH, Heidenheim, Germany

[21] Appl. No.: 892,058

[22] Filed: Jul. 15, 1997

[30] Foreign Application Priority Data

Jul. 24, 1996 [DE] Germany ..... 196 29 885.7

[51] Int. Cl.[6] ..... D21F 3/08

[52] U.S. Cl. ..... 162/205; 100/153; 100/168; 162/358.3; 162/272; 492/22; 492/47

[58] Field of Search ..... 162/358.3, 205, 162/272, 273, 199; 100/168, 153; 492/22, 47

[56] References Cited

U.S. PATENT DOCUMENTS

| | | | |
|---|---|---|---|
| 4,975,152 | 12/1990 | Filzen et al. | 162/358.3 |
| 5,084,137 | 1/1992 | Ilmarinen et al. | 162/358.3 |
| 5,098,523 | 3/1992 | Ilmarinen | 162/358.3 |
| 5,577,441 | 11/1996 | Grabscheid | 100/168 |
| 5,643,416 | 7/1997 | Lange et al. | 162/199 |

FOREIGN PATENT DOCUMENTS

| | | |
|---|---|---|
| 3338487 | 5/1985 | Germany . |
| 3607941 | 5/1987 | Germany . |

*Primary Examiner*—Karen M. Hastings
*Attorney, Agent, or Firm*—Greenblum & Bernstein, P.L.C.

[57] ABSTRACT

Press device and method for treating a material web. The press device may include a shoe press roll that includes a flexible, tubular press jacket, face plates, face plate bearings associated with the face plates, a carrier axially extending through the press jacket, the face plates coupled with axial ends of the press jacket, and a press shoe device. The press device may also include an opposing element such that the shoe press roll and the opposing element may be adapted to form a nip. The carrier may support the press shoe device and may carry the face plate bearings, and the face plates, during an unloaded state of the shoe press roll, may be arranged inclined in opposite directions to form a press jacket mount that widens in a direction of the nip. The method may include exerting no load on the shoe press roll, providing a carrier supporting a roll jacket, positioning ends of a roll jacket of the shoe press roll to be non-parallel with respect to each other to form a longest and shortest longitudinal surface of the roll jacket, and adapting a position of the longest longitudinal surface for receiving a load and for forming a press nip.

26 Claims, 1 Drawing Sheet

EXTENDED NIP PRESS DEVICE WITH INCLINED END FACE PLATES

CROSS-REFERENCE TO RELATED APPLICATION

The present application claims priority under 35 U.S.C. § 119 of German Patent Application No. 196 29 885.7, filed on Jul. 24, 1996, the disclosure of which is expressly incorporated by reference herein in its entirety.

BACKGROUND OF THE INVENTION

1. Field of the Invention

The present invention relates to a press device for treating a material web, e.g., a paper web, that includes a shoe press roll having a flexible, tubular press jacket and a press shoe device. The tubular press jacket may be coupled on its axial ends to rotatably supported face plates and the press shoe roll may be pressed against an opposing element by the press shoe device to form a nip. The press shoe device may also include a carrier axially passing through the press jacket to support the press shoe device and to carry the plate bearings associated with the face plates.

2. Discussion of Background Information

In generally similar type press devices of the prior art, the face plates of the unloaded shoe press roll are arranged in planes that are essentially perpendicular to the press jacket axis. During operation of the press, if the carrier deflects, e.g., due to the pressing force exerted between the press shoe roll and the opposing element, the face plates are inclined in opposite directions to essentially form a press jacket mount that tapers in the direction of the nip. As a result, the press jacket connected to the face plates is axially compressed on the side oriented toward the nip and is axially stretched on the side remote from the nip. Particularly in the edge region of the press jacket, this disadvantageously produces creases in the compressed region (the nip) and overstretches in the stretched region (opposite the nip). The material of the rotating press jacket is therefore continually subjected to alternating stresses in opposite directions, which leads to fatigue of the press jacket material and, consequently, shortens the press jacket service life. Furthermore, because of the creasing of the press jacket, there is a danger of impairing the perfect treatment of the material web guided through the nip.

SUMMARY OF THE INVENTION

Therefore, the present invention provides a press device for treating a material web in which the press jacket has as long a service life as possible.

The above feature may be achieved in accordance with the present invention such that, in the unloaded state, the face plates of the shoe press may be arranged to be inclined in opposite directions, thus, forming a press jacket mount that widens in a direction of the nip.

As is known, during operation of a shoe press, the shoe press carrier is generally deflected in a load-dependent manner. To compensate for the adverse effects associated with this operational deflection, an initial, unloaded inclination of at least one of the face plates is provided in the shoe press mount. Thus, during press operation, the inclination of the face plates, i.e., with respect to the nip, may be less than the inclination had there been no unloaded inclination, i.e., as is the prior art shoe press. In other words, when the shoe press of the present invention is in the operating state, the initially inclined face plates substantially right themselves from their inclined rest state. In this manner, the axial loading of the press jacket may be made substantially uniform over its entire circumference and, therefore, stresses that generally harm and shorten service life of the press jacket may be significantly reduced.

The tension function of the face plates, which ensures axial tension of the press jacket necessary for the preferred operation of the press, is not impaired by the inclination of the face plates according to the invention.

According to a preferred embodiment of the present invention, the initial inclination of the face plates, i.e., when the carrier is not deflected, may be less than the opposing (resulting) inclination occurring at maximal load during operation of the shoe press. Thus, an undesirable stressing of the press jacket, i.e., when the shoe press is not in operation, may be substantially prevented.

According to another embodiment of the press device according to the present invention, the inclination of the face plates in the unloaded state of the shoe press roll may be selected such that, at a rated load, the face plates may be arranged in planes that are substantially parallel to each other. Consequently, at a deflection of the carrier caused by the rated load, the press jacket should not subjected to any damaging axial compressions or tensions. Thus, during the majority of the shoe press operation, which occurs at the rated load, there are substantially no forces occurring that may lead to a shortening of the normal service life of the press jacket. Furthermore, the present invention ensures a substantially perfect press treatment of the material web, e.g., undamaged by creasing of the press jacket.

In another exemplary embodiment of the shoe press device formed in accordance with the present invention, the face plates may be rotatably supported on bearing cases supported on the carrier.

According to another embodiment of the shoe press device of the present invention, the face plates may be arranged to be axially immobile with respect to the bearing cases. Since the bearing cases carrying the face plates consequently need only to be axially moved to adjust the tension of the press jacket, utilization and provisioning of complicated face plate bearings, which must permit simultaneous rotation movement and axial movement of the face plates, is not necessary in the shoe press device according to the present invention.

The present invention may be directed to a press device for treating a material web. The press device may include a shoe press roll that includes a flexible, tubular press jacket, face plates, face plate bearings associated with the face plates, a carrier axially extending through the press jacket, the face plates coupled with axial ends of the press jacket, and a press shoe device. The press device may also include an opposing element such that the shoe press roll and the opposing element may be adapted to form a nip. The carrier may support the press shoe device and may carry the face plate bearings, and the face plates, during an unloaded state of the shoe press roll, may be arranged inclined in opposite directions to form a press jacket mount that widens in a direction of the nip.

According to another feature of the present invention, the inclination of the face plates during the unloaded state of the shoe press roll may be less than an opposing inclination during a maximal load of the shoe press roll. Further, the inclination of the face plates during the unloaded state of the shoe press roll may be between approximately one-sixth and one-half the opposing inclination during the maximal load of the shoe press roll.

According to still another feature of the present invention, the face plates may be substantially parallel during a rated load of the shoe press roll.

According to another feature of the present invention, the press device may include bearing cases supported on the carrier that rotatably support the face plates. Further, each bearing case may include a circumference face that forms a bearing for a respective one face plate, the press jacket may have a press jacket axis, and the circumference face of each bearing case may extend obliquely with respect to the press jacket axis in accordance with the inclination of the respective one face plate. Still further, the face plates may be axially immobile with respect to the bearing cases.

According to a further feature of the present invention, the press device may include support pins axially extending from the carrier and each bearing case may be positioned on a support pin. Further, the bearing cases may be axially movable and rotationally immobile with respect to the support pins.

According to still another feature of the present invention, the press shoe device may include at least one press shoe cooperating with the press jacket and a support device, having a plurality of individually controllable support elements, supporting the press shoe on the carrier.

According to another feature of the present invention, the opposing element may include a counter roll.

According to a still further feature of the present invention, the inclination of the face plates during the unloaded state may be adjustable as a function of an expected load of the shoe press roll to be utilized during operation of the press device.

According to another feature of the present invention, the carrier may include a longitudinal axis. One of the face plates, during the unloaded state of the shoe press roll, may be arranged inclined relative to the longitudinal axis to form an obtuse angle with a portion of the carrier axis facing the nip.

According to yet another feature of the present invention, the material web may include a paper web.

The present invention may be directed to a shoe press roll for use in a press device. The shoe press roll may include a roll jacket having a longitudinal axis and a longitudinal portion for forming a nip, a first and a second face plate coupled at axial ends of the roll jacket, and at least one of the first and the second face plates being obliquely arranged with respect to the longitudinal axis. The longitudinal portion may include a longest longitudinal extent of the roll jacket.

According to another feature of the present invention, the press shoe roll may also include a carrier that supports the roll jacket and pins extending from the carrier along the longitudinal axis of the roll jacket. A face plate bearing may be associated with each of the first and the second face plates and may be oriented in a substantially same direction as the associated first and second face plates. Further, the face plate bearings may be axially movable with respect to the pins and the face plate bearing may be positionally immobile with respect to the associated first and second face plate. The shoe press roll may additionally include a first bearing case associated with a first pin to rotatably support the first face plate and a second bearing case associated with a second pin to rotatably support the second face plate. The axial movement of the face plate bearing may adjust a tension in the roll jacket.

According to still another feature of the present invention, the shoe press roll may include a plurality of support elements for supporting the longitudinal portion and the plurality of support elements may be aligned along an interior surface of the roll jacket.

According to a further feature of the present invention, the at least one of the first and the second face plates obliquely arranged with respect to the longitudinal axis may include each of the first and the second face plates being obliquely arranged with respect to the longitudinal axis. Further, the obliquely arranged first and second face plates may form a respective first and second angle with respect to the longitudinal axis. The first and second angle may be a function of an expected load of the shoe press roll during operation of the press device.

The present invention may be directed to a method for arranging a shoe press roll in a press device. The method may include exerting no load on the shoe press roll, providing a carrier supporting a roll jacket, positioning ends of a roll jacket of the shoe press roll to be non-parallel with respect to each other to form a longest and shortest longitudinal surface of the roll jacket, and adapting a position of the longest longitudinal surface for receiving a load and for forming a press nip.

According to another feature of the present invention, the method may also include exerting a rated operating load on the shoe press, and deflecting the carrier such that the ends of the roll jacket of the shoe press roll are positioned substantially parallel with respect to each other.

According to yet another feature of the present invention, the method may also include exerting a maximal load on the shoe press, deflecting the carrier, and positioning the ends of the roll jacket of the shoe press roll to be non-parallel with respect to each other. The nip including the shortest longitudinal surface.

Other exemplary embodiments and advantages of the present invention may be ascertained by reviewing the present disclosure and the accompanying drawing figures.

BRIEF DESCRIPTION OF THE DRAWINGS

The present invention may be further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

Figure 1:
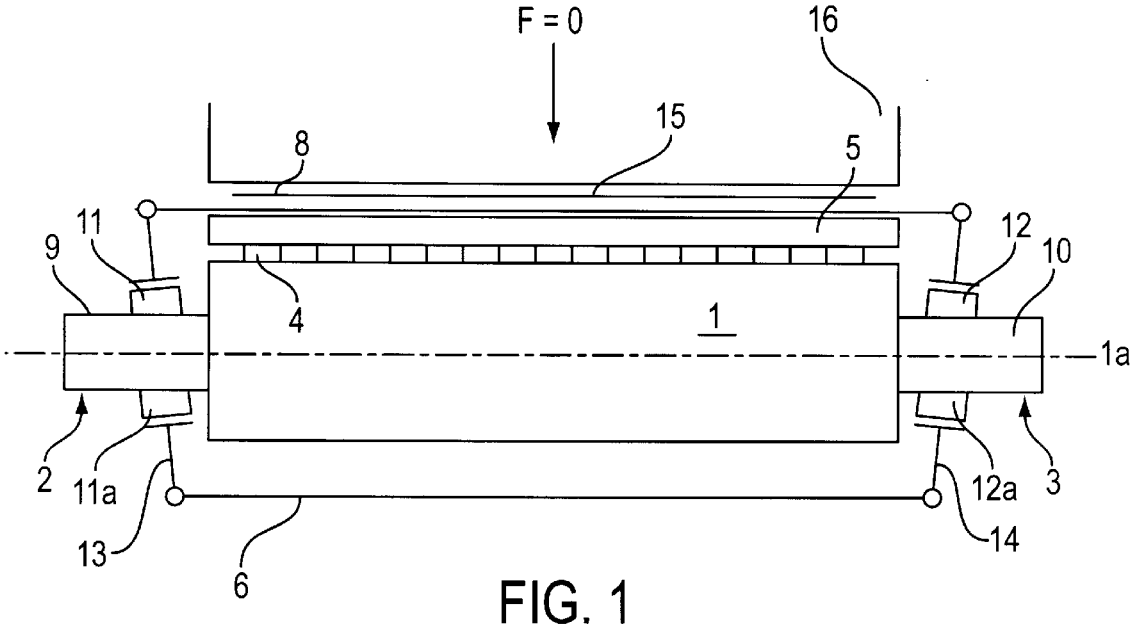
FIG. 1 illustrates a schematic side view of a shoe press roll in an unloaded state.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figures making apparent to those skilled in the art how the invention may be embodied in practice.

The shoe press roll according to FIG. 1 may include a flexible, tubular press jacket 6, and face plates 13 and 14. Face plates 13 and 14 may be coupled to opposite axial ends of tubular press jacket 6. In accordance with this exemplary embodiment, press jacket 6 may be attached to an edge region of face plates 13 and 14. A carrier 1, which may be, e.g., cylindrical in shape, may be coaxially positioned within press jacket 6 so that, in an unloaded condition, both carrier 1 and press jacket 6 have a same longitudinal axis 1*a*. Support pins 9 and 10 may extend from opposite axial ends of carrier 1, such that pins 9 and 10 are coaxial with carrier 1, and may carry respective bearing cases 11 and 12. Bearing cases 11 and 12 may also be utilized to rotatably support face plates 13 and 14. Support for the shoe press roll, e.g., on a machine frame has been schematically indicated by arrows 2 and 3.

Face plates 13 and 14 may be arranged so that they may be axially immobile with respect to bearing cases 11 and 12. However, bearing cases 11 and 12 may be axially movable on support pins 9 and 10 of carrier 1 to adjust the axial tension on press jacket 6. Bearing cases 11 and 12 may also be arranged to be rotationally immobile with respect to support pins 9 and 10.

Press jacket 6 may include a support device having one or more parts extending over an entire axial length of carrier 1. For example, the support device may be formed, e.g., by a continuous press shoe 5 and a plurality of support elements 4 located one after another in the axial direction. Support elements 4 may be, e.g., piston/cylinder devices that may be operated by at least one of hydraulically and pneumatically. Press jacket 6, during operation, may be pressed against an opposing element 16, e.g., a cylindrical roll, by operation of the support device.

Between opposing element 16 and press jacket 6, a nip 15 may be formed. Further, a press felt 8 may be guided through nip 15 to carry or guide a material web, not shown, during operation of the shoe press.

Outer circumference faces 11*a* and 12*a* of respective bearing cases 11 and 12 may be utilized as rotational supports for face plates 13 and 14, respectively. Further, in the unloaded condition depicted in FIG. 1, outer circumference faces 11*a* and 12*a* and face plates 13 and 14 may be arranged to extend obliquely with respect to press jacket axis 1*a*. In this manner, when the press is not in operation, i.e., when no force is exerted on the shoe press roll by the opposing element and carrier 1 is not undergoing any deflection, face plates 13 and 14 supported on oblique circumference faces 11*a* and 12*a*, respectively, may be inclined in opposite directions and may form a press jacket mount that widens in a direction of nip 15. Therefore, when axial tension forces are exerted on bearing cases 11 and 12, press jacket 6 may experience a greater axial tension in a region of nip 15 than may be experienced on the side remote from nip 15.

Figure 2:
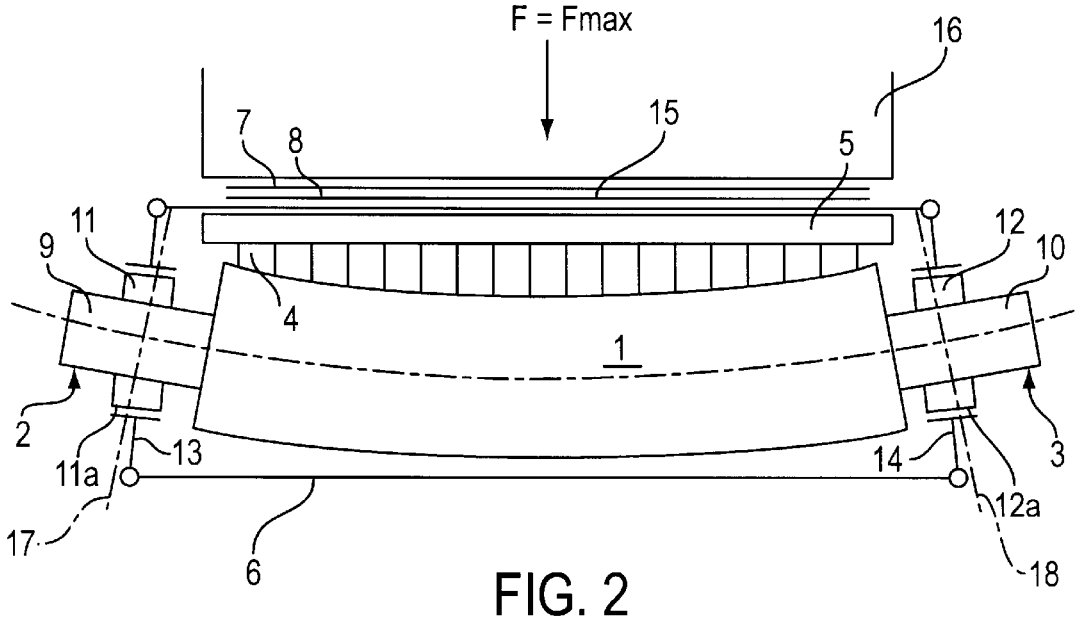
FIG. 2 illustrates shoe press roll depicted in FIG. 1 in a maximally loaded state by an opposing element.

FIG. 2 illustrates the shoe press roll depicted in FIG. 1 during operation, e.g., when a maximal force $F_{max}$ may be exerted on the shoe press roll by opposing element 16. Further, FIG. 2 illustrates material web 7, which is to be treated during the operation of the press shoe roll and which may be guided through nip 15 together with press felt 8.

As discussed above, press shoe 5 may be acted upon by a plurality of individually controllable support elements 4 so that press shoe 5 and opposing roll 16 may form a smooth nip 15, which may be independent of the load. Further, in this exemplary arrangement, only carrier 1 is deflected. The deflection of carrier 1 may result in face plates 14 and 15 being righted out of their initial (unloaded) inclination, i.e. the initial inclination is reduced.

In the exemplary embodiment according to FIG. 2, the inclination of face plates 13 and 14 that may occur under maximal load may result in an inclination of face plates 13 and 14 to form a face plate mount that may taper in the direction of nip 15.

The face plate inclination that may occur under the maximal load is a function of the magnitude of the deflection of carrier 1 and of the initial (unloaded) inclination of face plates 13 and 14 of the shoe press roll. Thus, by suitable adjustment of the initial face plate inclination, the shoe press roll, in accordance with the present invention, may be arranged such that under a known maximal load, face plates 13 and 14 may be deflected from their initial inclination to a predetermined maximal loaded inclination.

The inclination of face plates 13 and 14 in the unloaded state of the shoe press roll may be, e.g., less than the opposing inclination of face plates 13 and 14 under maximal load, and may preferably be, e.g., between approximately one-sixth to one-half of the maximal loaded inclination.

Dot-and-dash lines 17 and 18 shown in FIG. 2 depict an inclination that face plates 13 and 14 would have assumed under maximal load in a prior art shoe press roll in which the face plates are initially substantially parallel to each other. Therefore, the inclination of face plates 13 and 14, i.e., in accordance with the present invention, may result in axial compression and stretching of press jacket 6, occurring at maximal loading of the shoe press roll, that is markedly reduced from that available in the prior art.

Thus, in accordance with the features of the present invention, the initial (unloaded) inclination of face plates 13 and 14 may be selected so that, at a rated load of the shoe press roll, i.e., a load for which a majority or preponderance of the web treatment or shoe press operation may occur, the deflection of carrier 1 will deflect bearing casings 11 and 12 and face plates 13 and 14 from the initial inclination to a position in which face plates 13 and 14 are substantially parallel to each other. Accordingly, in the axial direction, press jacket 6 may be subjected to a substantially uniform tension force over its entire circumference, i.e., produced by face plates 13 and 14. In this manner, under normal operation, axial compressions and tensions, which may lead to adverse creasing and overstretching of press jacket 6, do not occur.

The present invention permits undesired axial stresses of press jacket 6, which may be caused by deflection of carrier 1, to be reduced or even, at least during normal operation, to be substantially or totally prevented. In this manner, the service life of the press jacket may be considerably lengthened.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A press device for treating a material web comprising:

a shoe press roll comprising:

a flexible, tubular press jacket;

face plates;

face plate bearings associated with the face plates;

a carrier axially extending through the press jacket;

the face plates coupled with axial ends of the press jacket; and a press shoe device;

an opposing element;

the shoe press roll and the opposing element adapted to form a nip;

the carrier supporting the press shoe device and carrying the face plate bearings; and the face plates, during an unloaded state of the shoe press roll, being arranged inclined in opposite directions to form a press jacket mount that widens in a direction of the nip.

2. The press device according to claim 1, wherein the inclination of the face plates during the unloaded state of the shoe press roll is less than an opposing inclination during a maximal load of the shoe press roll.

3. The press device according to claim 2, wherein the inclination of the face plates during the unloaded state of the shoe press roll is between approximately one-sixth and one-half the opposing inclination during the maximal load of the shoe press roll.

4. The press device according to claim 1, wherein the face plates are substantially parallel during a rated load of the shoe press roll.

5. The press device according to claim 1, further comprising bearing cases supported on the carrier that rotatably support the face plates.

6. The press device according to claim 5, each bearing case comprising a circumference face that forms a bearing for a respective one face plate;

the press jacket having a press jacket axis; and the circumference face of each bearing case extending obliquely with respect to the press jacket axis in accordance with the inclination of the respective one face plate.

7. The press device according to claim 5, the face plates being axially immobile with respect to the bearing cases.

8. The press device according to claim 1, further comprising support pins axially extending from the carrier; and each bearing case being positioned on a support pin.

9. The press device according to claim 8, the bearing cases being axially movable and rotationally immobile with respect to the support pins.

10. The press device according to claim 1, the press shoe device comprising at least one press shoe cooperating with the press jacket and a support device, including a plurality of individually controllable support elements, supporting the press shoe on the carrier.

11. The press device according to claim 1, the opposing element comprising a counter roll.

12. The press device according to claim 1, wherein the inclination of the face plates during the unloaded state is adjustable as a function of an expected load of the shoe press roll to be utilized during operation of the press device.

13. The press device according to claim 1, the carrier comprising a longitudinal axis, wherein one of the face plates, during the unloaded state of the shoe press roll, is arranged inclined relative to the longitudinal axis to form an obtuse angle with a portion of the carrier axis facing the nip.

14. The press device according to claim 1, the material web comprising a paper web.

15. A shoe press roll for use in a press device comprising:

a roll jacket having a longitudinal axis and a longitudinal portion for forming a nip;

a first and a second face plate coupled at axial ends of said roll jacket;

at least one of said first and said second face plates being obliquely arranged with respect to said longitudinal axis; and said longitudinal portion including a longest longitudinal extent of said roll jacket.

16. The shoe press roll according to claim 15, further comprising:

a carrier that supports said roll jacket;

pins extending from said carrier along said longitudinal axis of said roll jacket; and a face plate bearing associated with each of said first and said second face plates and oriented in a substantially same direction as said associated first and second face plates.

17. The shoe press roll according to claim 16, said face plate bearings being axially movable with respect to said pins; and said face plate bearing being positionally immobile with respect to said associated first and second face plate.

18. The shoe press roll according to claim 17, further comprising a first bearing case associated with a first pin to rotatably support the first face plate; and a second bearing case associated with a second pin to rotatably support the second face plate.

19. The shoe press roll according to claim 18, said axial movement of said face plate bearing adjusting a tension in said roll jacket.

20. The shoe press roll according to claim 15, further comprising:

a plurality of support elements for supporting the longitudinal portion; and said plurality of support elements aligned along an interior surface of said roll jacket.

21. The shoe press roll according to claim 15, said at least one of said first and said second face plates being obliquely arranged with respect to said longitudinal axis comprising each of said first and said second face plates being obliquely arranged with respect to said longitudinal axis.

22. The shoe press roll according to claim 21, said obliquely arranged first and second face plates forming a respective first and second angle with respect to said longitudinal axis; and said first and second angle is a function of an expected load of the shoe press roll during operation of the press device.

23. A method for arranging a shoe press roll in a press device comprising:

exerting no load on the shoe press roll;

providing a carrier supporting a roll jacket of the shoe press roll; and positioning ends of the roll jacket of the shoe press roll to be non-parallel and inclined with respect to each other to form a longest and shortest longitudinal surface of the roll jacket; and using a position of the longest longitudinal surface for receiving a load and for forming a press nip.

24. The method according to claim 23, wherein after the using of the position of the longest longitudinal surface for receiving the load and for forming a press nip, the method further comprising:

exerting a rated operating load on the shoe press; and deflecting the carrier such that the ends of the roll jacket of the shoe press roll are now positioned substantially parallel with respect to each other.

25. The method according to claim 23, wherein after the using of the position of the longest longitudinal surface for receiving the load and for forming a press nip, the method further comprising:

exerting a maximal load on the shoe press;

deflecting the carrier; and positioning the ends of the roll jacket of the shoe press roll to be non-parallel with respect to each other, wherein the nip now includes the shortest longitudinal surface, and wherein the maximal force forces the face plates to incline in a direction opposite the inclination of the no load position.

26. The method according to claim 23, the positioning of ends of the roll jacket of the shoe press roll comprising:

placing face plates at axial ends of the roll jacket; and arranging the face plates to be non-parallel and inclined with respect to each other to form the longest and shortest longitudinal surface of the roll jacket.

* * * * *